US006491791B1

(12) United States Patent
Loippo

(10) Patent No.: US 6,491,791 B1
(45) Date of Patent: Dec. 10, 2002

(54) APPARATUS AND METHOD FOR TREATING ROLL SURFACES AND/OR FABRICS

(75) Inventor: Kimmo Loippo, Jokihaara (FI)

(73) Assignee: Runtech Systems Oy, Kolho (FI)

( * ) Notice: Subject to any disclaimer, the term of this patent is extended or adjusted under 35 U.S.C. 154(b) by 0 days.

(21) Appl. No.: 09/816,323

(22) Filed: Mar. 26, 2001

(30) Foreign Application Priority Data

Mar. 20, 2001 (FI) ..... 20010563

(51) Int. Cl.[7] ..... D21F 1/32
(52) U.S. Cl. ..... 162/199; 162/274; 162/276
(58) Field of Search ..... 162/198, 199, 162/263, 272, 252, 274, 275, 276, 277, 278, 279; 134/15, 21, 24, 122 R; 15/256.51, 256.52, 256.53, 309.1; 198/497–499; 399/350, 351

(56) References Cited

U.S. PATENT DOCUMENTS 1,550,994 A * 8/1925 Vickery ..... 162/199
3,841,910 A * 10/1974 Baker ..... 134/15
4,185,399 A * 1/1980 Gladish ..... 34/120
4,270,978 A * 6/1981 Fioravanti ..... 162/199
4,474,644 A * 10/1984 Poulsen ..... 162/199
4,698,134 A * 10/1987 Green et al. ..... 162/199
5,944,956 A * 8/1999 Marcheggiani ..... 162/199
6,099,691 A * 8/2000 Clarke et al. ..... 162/279
6,139,638 A * 10/2000 Dubois et al. ..... 118/413

FOREIGN PATENT DOCUMENTS

WO WO0112898 A1 2/2001 ..... D21G/9/00

* cited by examiner

*Primary Examiner*—Steven P. Griffin
*Assistant Examiner*—Eric Hug
(74) *Attorney, Agent, or Firm*—Birch, Stewart, Kolasch & Birch, LLP

(57) ABSTRACT

A method is disclosed for cleaning roll surfaces on a paper-making machine or the like, particularly the grooves and drilled perforations of the rolls, and/or supported fabrics and/or for improving water drainage therein. According to the method, the properties of a moving roll surface (1) and/or fabric (6), as well as their behavior during a run, are affected by means of a gas mixture (5) in a manner, wherein the flow of the gas mixture is caused to be directed substantially toward the roll surface (1), grooves (2) made on the roll shell, perforations (2) of the roll shell and/or the fabric (6) or, alternatively, at least to a close proximity of at least one of the foregoing objects. The invention also relates to an apparatus suited for implementing the method.

18 Claims, 5 Drawing Sheets

APPARATUS AND METHOD FOR TREATING ROLL SURFACES AND/OR FABRICS

The present invention relates to a method according to the preamble of claim 1 for cleaning roll surfaces on a papermaking machine or the like, particularly the grooves, drilled perforations thereof and/or supported fabrics, and/or improving water drainage therein. The invention also relates to an apparatus according to the preamble of claim 8 suited for implementing the method.

In the art are known generally a plurality of different arrangements for cleaning roll surfaces and/or fabrics on a papermaking machine or equipment of a similar kind. For instance, an arrangement is known wherein the rolls of a papermaking machine, particularly its grooved-shell rolls, suction rolls, dryer rolls or other similar rolls, are cleaned by doctoring the rolls with the help of a doctor blade made from a polymer material, glass fiber, carbon fiber, steel or a combination thereof. This action serves by means of doctoring to clean the surface of a roll, particularly the grooves and/or perforations thereof and to remove water and dirt from the grooves and/or perforations and/or from the surface of the roll. The prior-art approaches are especially problematic in regard to the grooves and/or perforations of a roll when water and dirt must be removed therefrom. Particularly on the wire and press sections, water and/or dirt will adhere to the grooves and/or perforations of the rolls thus staying persistingly therein, which leads to inferior water drainage performance of the rolls/fabrics of a papermaking machine, reduced efficiency in the papermaking process, deteriorated quality of the web and a possible need to run the papermaking machine at a lower speed, whereby production loss is inevitable.

It is an object of the present invention to provide an entirely novel kind of arrangement for eliminating the reduction of operating efficiency in rolls and/or fabrics and for eliminating runnability problems on a paper/boardmaking machine or the like due to dirt plugging different kinds of roll surfaces and/or fabrics and by the effect of water and dirt adhering to the roll grooves and/or holes and/or fabrics. The goal of the invention is achieved by means of doctoring the surface of a roll with a novel type of doctoring apparatus, wherein pressurized gas, particularly compressed air, is used for generating to the incoming or outgoing side of a doctoring member such an overpressure or vacuum that enhances the water and dirt removal capabilities of the novel doctoring arrangement. The feed of the cleaning gas such as compressed air, is implemented using a purpose-designed gas ejection device suited for application of cleaning gas according to the invention to the surface of a roll and/or grooves and/or perforations of the roll surface. Additionally, the method and apparatus according to the invention can be used for cleaning, drying and removing water and dirt from the fabrics of a papermaking machine or the like machinery.

During its manufacture, the apparatus according to the invention can be provided with different kinds of integral sensors such as thermocouple wires and the like sensors suited for measuring the temperature and/or temperature profile of roll surfaces, for instance. Furthermore, it is possible to incorporate pressure, deflection, vibration or the like sensors that serve to monitor, e.g., the loading profile and/or possible leak-throughs under the doctoring elements, as well as moisture content, speed, acceleration and other sensors serving to monitor, e.g., the operational state of the doctoring element and/or roll and/or fabric.

More specifically, the invention is characterized by what is stated in the appended claims.

The arrangement according to the invention offers a number of significant benefits. The injection assembly of the cleaning gas such as compressed air can be used in a plurality of different applications. The apparatus is suited, e.g., for cleaning roll surfaces on a papermaking machine and removal of water and plugging materials from the grooves and/or perforations of roll surfaces. Additionally, the method and apparatus according to the invention is usable for cleaning, drying, water drainage and dirt removal on fabrics on a papermaking machine or the like.

Conventional cleaning or doctoring methods and apparatuses leave an excessively large amount of water and/or dirt on the surface and/or the grooves and/or perforations of a roll. This results in a reduced water drainage capacity and/or efficiency on the wire and press sections of a papermaking machine, problems in web runnability, web breaks and/or defects on the web. For instance, the grooves of grooved-shell rolls remain filled with a layer of water and/or dirt inasmuch a conventional doctor due to its linear shape and function cannot touch or clean but the outermost surface of roll. Conventional doctoring apparatuses and methods are also incapable of cleaning drilled holes of a perforated suction roll free from water and/or dirt due to the superficial contact of the scraping element with the roll surface alone. Today, separately mounted high-pressure water jets in cooperation with suction systems are being used for cleaning fabrics on a papermaking machine and the like systems. In these systems, the low efficiency of the cleaning equipment in regard to the high investment cost is a great disadvantage. Moreover, a fabric passed through such cleaning equipment still contains water and dirt, such as fiber and various surface sizes or fillers and adhesives.

The method and apparatus according to the invention intended for cleaning and/or doctoring of roll surfaces, particularly those of grooved-shell and/or suction rolls, on a papermaking machine achieve improved efficiency by virtue of an arrangement specifically developed for the implementation of the invention, in which arrangement pressurized gas, such as compressed air, is used for generating on the ingoing and/or outgoing side and/or interior space of a doctoring assembly according to the invention and/or between the doctor blades acting as the delineating walls of the doctoring assembly such a high pressure or a vacuum that serves to improve the water and dirt removal capabilities of the novel type of doctoring assembly. For instance, a first embodiment of the doctoring assembly intended for use on a grooved-shell roll is characterized in that the doctoring assembly is comprised of two doctor blades mounted in the same doctoring assembly complemented with a purpose-designed gas chamber such as a compressed-air chamber. The interblade space forms a closed and tightly delineated pocket whereto gas, particularly compressed air, can be passed from the compressed-air chamber of the doctoring assembly in a purpose-designed and controlled manner via openings, nozzles and/or slits made according to the invention to the wall of the chamber in a purpose-designed and controlled manner. Consequently, into the pocket between doctor blades of the doctoring assembly can be formed by the introduced gas, particularly compressed air, a high pressure that tends to escape outward via the grooves of the grooved-shell roll from under the first doctor blade of the doctoring assembly to the front side, that is, the incoming side of the doctoring assembly. The pressurized gas or compressed air thus escaping from under the doctor blade via the grooves of the grooved-shell rolls forms in front of and under the doctor blade and into the grooves a high-pressure barrier zone that prevents water and/or dirt adhering to the roll grooves from passing with rotation of roll via and from under the doctor blade. A portion of the pressurized gas pumped into the interblade pocket, such as compressed air,tends to escape via the cleaned grooves of the grooved-shell roll from under the second doctor blade to the rear side, later called the outgoing side, of the doctoring assembly. The pressurized gas such as compressed air escaping from under the doctor blade, via the grooves of a grooved-shell roll, generates on the outgoing side of the doctoring assembly and particularly, under the doctor blade thereof, a high vacuum that works by way of an ejector effect so as to remove the possible remains of water and dirt still adhering to the grooves.

A second embodiment of the doctoring assembly intended for use on a suction roll is characterized in that the doctoring assembly is comprised of two doctor blades mounted in the same doctoring assembly complemented with a purpose-designed gas chamber such as a compressed-air chamber. The interblade space forms a closed and tightly delineated pocket into which gas, particularly compressed air, can be passed from the compressed-air chamber of the doctoring assembly in a purpose-designed and controlled manner via openings, nozzles and/or slits made to the wall of the chamber in a purpose-designed and controlled manner according to the invention. Consequently, into the pocket between doctor blades of the doctoring assembly can be formed by the introduced gas, particularly compressed air, a high pressure that tends to escape outward to the outgoing side of the doctoring assembly via openings, nozzles and/or slits that are made to the second doctor blade on the rear side the chamber in a purpose-designed and controlled manner. The pressurized gas such as compressed air thus escaping through said second, latter doctor blade forms behind and under the doctor blade a high-pressure barrier zone that works by way of an ejector effect so as to remove the possible remains of water and dirt still adhering to the perforations of the roll shell. In perforated suction rolls also having grooved shell, the above-described features of the doctoring assemblies may obviously be used in a combined manner.

Suction rolls, grooved-shell rolls and the like are today cleaned using a so-called foil formed by a thick strip of an elastomeric material. Now, a foil can be replaced by a doctoring assembly according to the invention, the doctoring assembly including an integral chamber for pressurized gas such as compressed air, whereby the cleaning gas such as compressed air is passed from the chamber via openings, nozzles and/or slits, which are made according to the invention in a purpose-designed manner to the wall of the compressed-air chamber of the doctoring assembly, in a controlled manner to the incoming or front side and/or to the outgoing side of the doctor element of the assembly or also therebehind and thereunder.

Respectively, the fabrics of a papermaking machine or the like are today cleaned by separately mounted high-pressure shower systems in combination with suction systems. Such conventional arrangements may be replaced by a doctoring assembly according to the invention, the doctoring assembly including an integral chamber for pressurized gas such as compressed air, whereby the gas such as compressed air is passed via openings, nozzles and/or slits, which are made in a purpose-designed manner to the wall of the compressed-air chamber of the doctoring assembly, in a controlled manner to the incoming or front side and/or to the outgoing side of the doctoring assembly or also therebehind and thereunder. The doctoring assembly is located to operate in a close proximity to the fabric of a papermaking machine or the like machinery.

The doctoring assembly according to the invention that is above described by way of exemplifying embodiments is capable of reducing the amount of water and/or dirt carried over in the grooves and/or perforations made on the rolls of the wire and press sections, thus offering improvement in the water removal properties of rolls and fabrics on a papermaking machine, a higher solids content of the produced web, enhanced efficiency in papermaking, higher quality of paper web and a possibility of increasing the speed of the papermaking machine, whereby all these factors in combination provide higher overall efficiency of production.

The doctoring assembly according to the invention described above by way of exemplifying embodiments can also be utilized to control the air pressure differences, air flows and similar factors at a close proximity to the surfaces of rolls, particularly those of the dryer cylinders, that affect web behavior.

Improved water drainage efficiency on a papermaking machine elevates the solids content of the web after the wire and press sections. The solids content of the web particularly after the press section has a tremendous economic impact inasmuch the amount of steam required for drying the web forms one of the major singular cost factors in papermnaking.

The doctoring assembly according to the invention can be further utilized to affect the properties of rolls, fabrics and/or the paper web, such as the uniformity of moisture and temperature profiles of the roll surfaces, fabrics and/or the paper web, and to reduce spot adhesion of the paper web to the fabrics at the outgoing side of the press.

Furthermore, the doctoring assembly according to the invention can be provided during its manufacture with different kinds of integral sensors such as thermo-couple wires and the like sensors suited for measuring the temperature and/or temperature profile of roll surfaces. It is also possible to incorporate pressure, deflection, vibration or the like sensors that serve to monitor, e.g., the loading profile and/or possible leak-throughs under the doctoring elements, as well as moisture content, speed, acceleration and other sensors serving to monitor, e.g., the operational state of the doctoring element. Such sensors integrated into the doctoring assembly according to the invention can be used for monitoring the properties of the doctoring elements, rolls, fabrics andlor the paper web, such as the moisture content, temperature, moisture and/or temperature profiles, the contact of the doctoring element with the roll and/or fabric surfaces, and the like parameters.

In addition to the functions described above, the doctoring assembly according to the invention can be used for cleaning, drying and unplugging the fabrics of a papermaking machine or the like machinery from water and dirt by way of using the assembly in the same fashion as a water foil.

In the following, the invention will be described in more detail with reference to the appended drawings in which FIG. 1 shows a simplified end view of a first embodiment of a doctoring assembly according to the invention suited for use on a grooved-shell roll;

Figure 1:
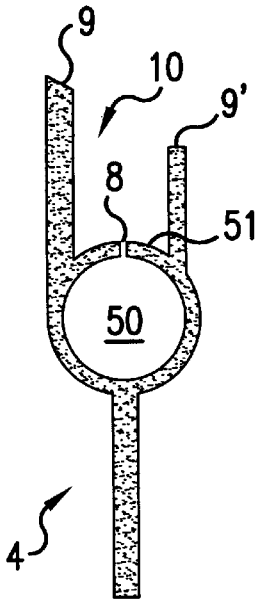
Figure 2:
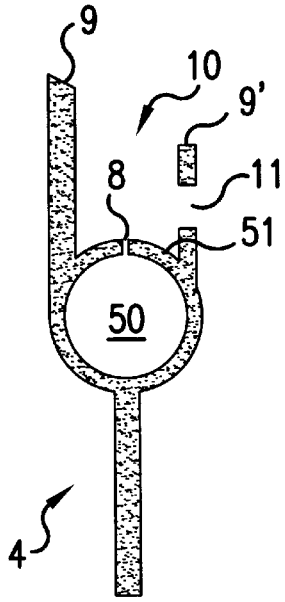
FIG. 2 shows a simplified end view of a second embodiment of a doctoring assembly according to the invention suited for use on a grooved-shell roll.
Figure 3:
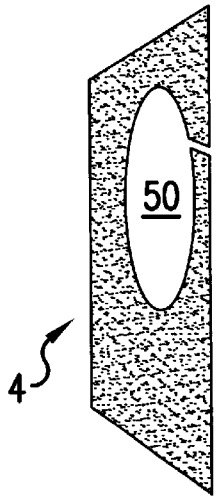
FIG. 3 shows a simplified end view of a third embodiment of a doctoring assembly according to the invention suited for use on a grooved-shell roll.
Figure 4:
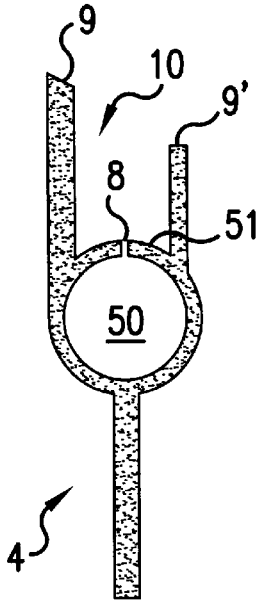
FIG. 4 shows a simplified end view of a first embodiment of a doctoring assembly according to the invention suited for use on a suction roll.
Figure 5:
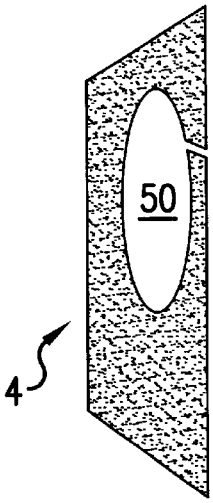
FIG. 5 shows a simplified end view of a second embodiment of a doctoring assembly according to the invention suited for use on a suction roll.
Figure 6:
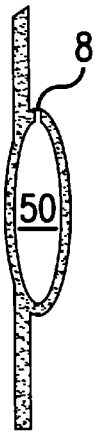
FIG. 6 shows a simplified end view of an embodiment of a doctoring assembly according to the invention suited for use on a suction roll.
Figure 7:
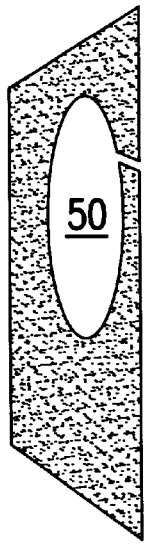
FIG. 7 shows a simplified end view of an embodiment of a doctoring assembly according to the invention suited for use on a fabric of a papermaking machine or the like machinery.
Figure 9:
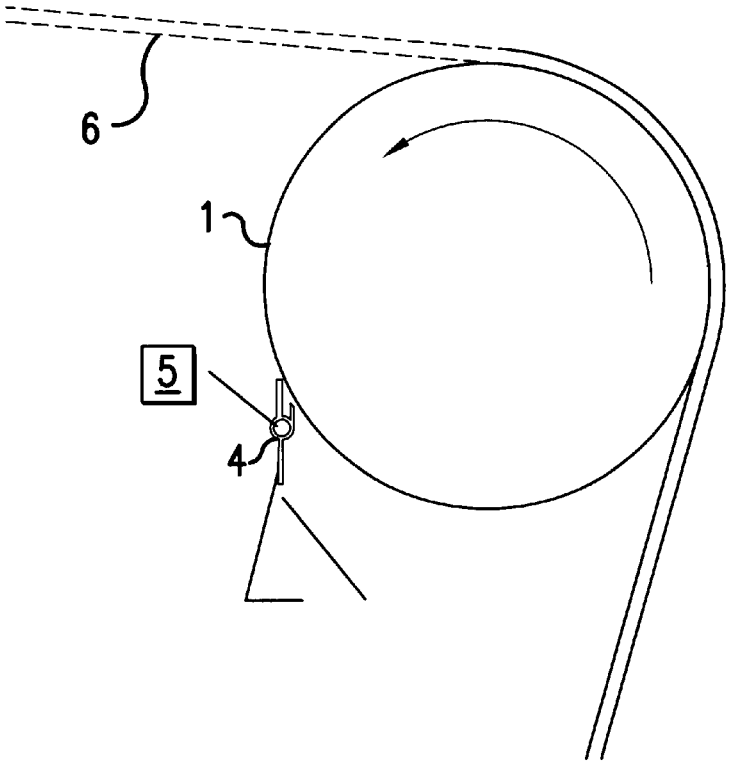
Figure 8A:
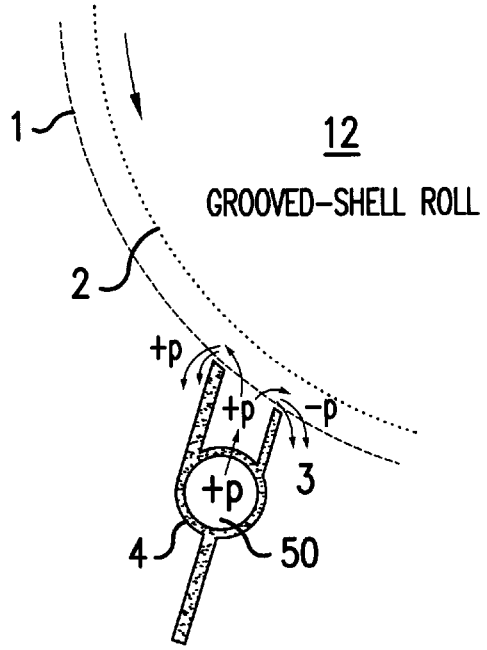
Figure 8B:
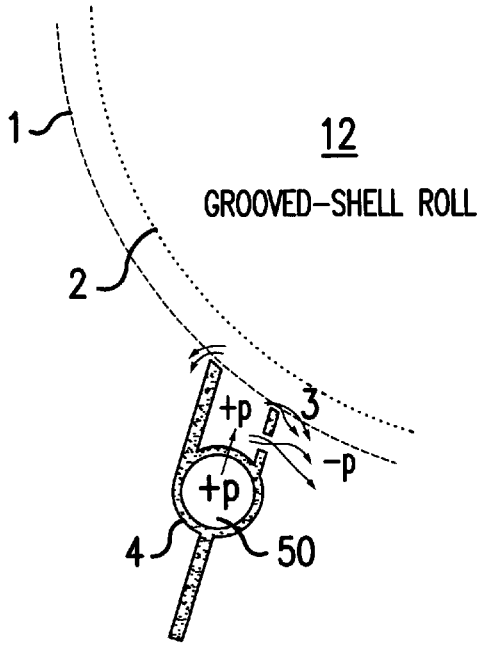
Figure 10:
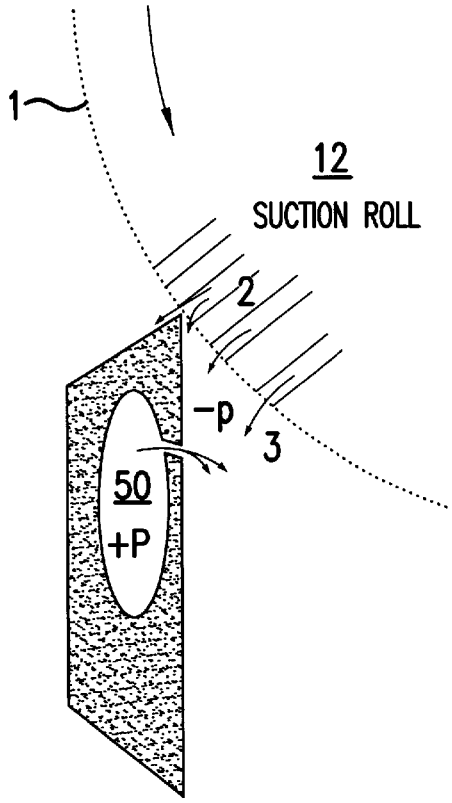
Figure 11:
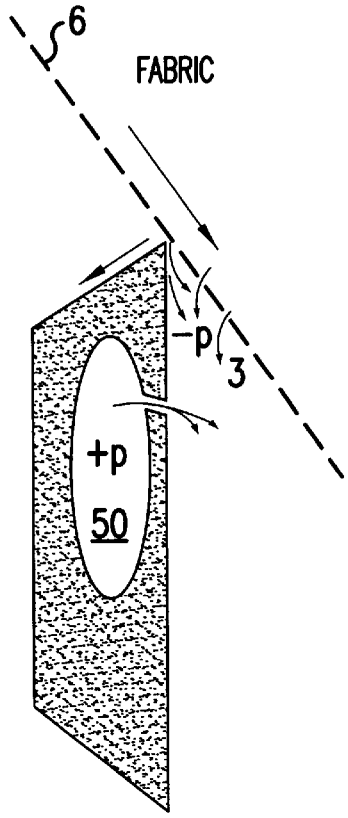
Figure 12:
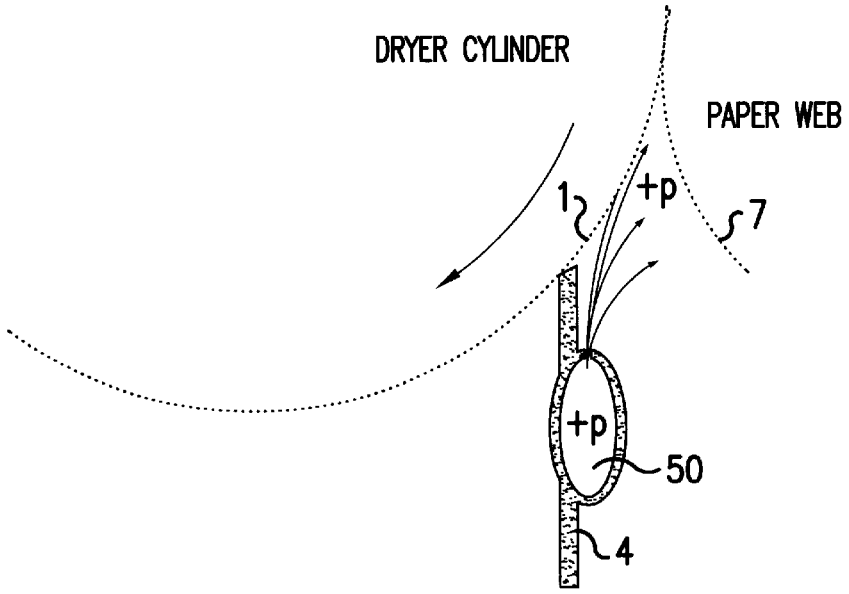

FIG. 8*a* shows a simplified end view of the operating principle of a first embodiment of a doctoring assembly according to the invention suited for use on a grooved-shell roll;

FIG. 8*b* shows a simplified end view of the operating principle of a second embodiment of a doctoring assembly according to the invention suited for use on a grooved-shell roll;

FIG. 9 shows a simplified end view of the location of an embodiment of a doctoring assembly according to the invention on a grooved-shell roll;

FIG. 10 shows a simplified end view of the operating principle and location of an embodiment of a doctoring assembly according to the invention on a suction roll;

FIG. 11 shows a simplified end view of the operating principle and location of an embodiment of a doctoring assembly according to the invention on a fabric of a papermaking machine or the like machinery; and FIG. 12 shows a simplified end view of the operating principle and location of an embodiment of a doctoring assembly according to the invention on the surface of a roll, such as a dryer cylinder, of a papermaking machine or the like machinery.

Figure 13:
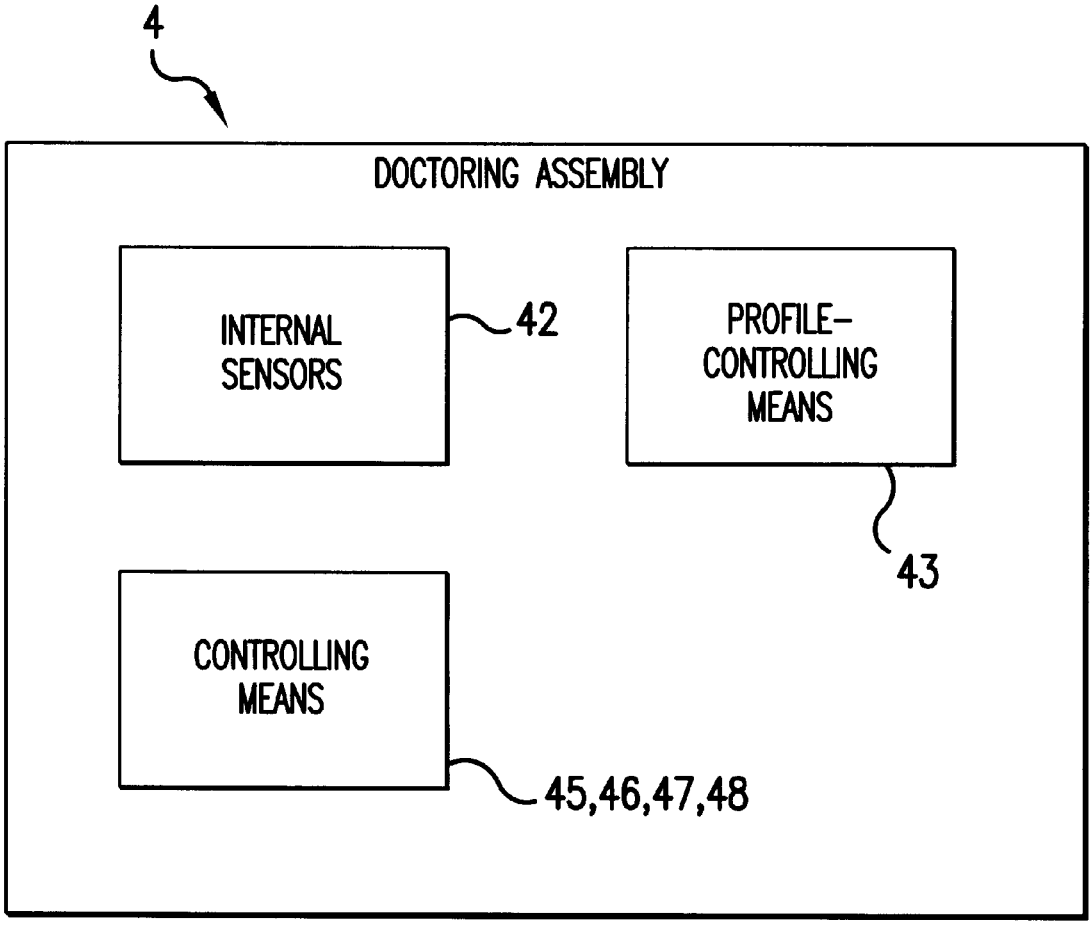

FIG. 13 shows a simplified diagram of the sensors and control means of a doctoring assembly accoeding to the invention.

As mentioned above, the present invention aims to provide an entirely novel kind of arrangement suited for combating the problems of reduced operational efficiency and runnability. of different kinds of roll surfaces and fabrics on a paper/boardmaking machine and the like machinery due to the accumulation and travel of dirt on different roll surfaces and/or fabrics and in the grooves and/or perforations of such surfaces. In the method according to the invention, the amount 3 of dirt and/or water adhering to a moving surface 1 of a roll and/or the grooves 2 and/or perforations 2 thereof is removed by means of a doctoring element 4 which is purpose-designed according to the invention and integrally incorporates a gas chamber, typically a compressed-air chamber, wherefrom gas 5, typically compressed air, is passed in a controlled manner via openings, nozzles and/or slits made to the wall of the compressed-air chamber of the doctoring assembly in a purpose-designed manner to the incoming or front side and/or to the outgoing or rear side of the doctoring assembly or therebehind or thereunder, against the roll surface and/or the grooves and/or perforations thereof and/or a fabric 6 or to a close proximity thereof.

The doctoring assembly according to the invention, particularly by virtue of the purpose-designed openings, nozzles or slits made to the wall of the cornpressed-air chamber of the doctoring assembly in accordance with the invention, makes it possible to control at least one property or the runnability or both of these roll-surface/fabric qualities and/or, therethrough, the properties, runnability or both of these qualities of a material web 7 running thereon through passing gas, particularly compressed air, in a controlled manner to the incoming or front side and/or to the outgoing or rear side of the doctoring assembly or therebehind or thereunder, against the roll surface and/or the grooves and/or perforations thereof and/or a fabric or to a close proximity thereof.

In the method, the gas is passed from the gas chamber in a controlled manner. The motion of the roll surface and/or fabric is monitored and the properties of the roll surface and/or fabric are affected by controlling the distribution, direction, amount, pressure, flow, composition, temperature and other qualities of the gas.

Through the control of cleaning gas distribution, it is possible to affect at least one of the following variables:

- moisture content and/or moisture profile of a roll surface and/or grooves and/or perforations or a roll shell and/or a fabric,
- cleanliness and/or cleaning of a roll surface and/or grooves and/or perforations of a roll shell and/or a fabric,
- temperature and/or temperature profile of a roll surface and/or a fabric,
- takeoff of material web from the surface of a roll,
- adherence of material web to the surface of a fabric,
- water content of the material web, e.g., through improved drainage of the web by virtue of reducing the amount of entrained water in the grooves and/or perforations of a roll shell and/or in a fabric,
- air entrained in a fabric,
- water permeability of the grooves and/or perforations of a roll shell and/or in a fabric,
- life of a fabric, and
- other factors complicating the runnability of a fabric, such as felt plugging and edge flutter of fabrics.

While the gas to be distributed through the assembly may contain a plurality of different components as required by specific needs and applications, in most cases compressed air may be used as such or, alternatively, in combination with some other gas.

Exemplifying embodiments of apparatuses according to the invention are shown in FIGS. 1–7. One of the doctoring assemblies according to the invention can be used, e.g., in a configuration related to a grooved-shell roll of a papermaking machine in the manner shown in FIGS. 8 and 9. These drawings illustrate a simplified view of a portion of a grooved-shell roll on a papermaking machine. Referring to FIG. 8*a*, therein is shown an embodiment of the doctoring assembly particularly intended for use on a grooved-shell roll, wherein the doctoring assembly 4 comprises two doctor blades mounted on the same doctoring assembly frame and a purpose-designed gas chamber 5 serving, e.g., as a compressed-air chamber. The interblade space forms a closed and tightly delineated pocket whereto gas, particularly compressed air, is passed in a purpose-designed and controlled manner from the compressed-air chamber of the doctoring assembly via openings, nozzles and/or slits made to the wall of the chamber in a manner according to the invention. Consequently, into the pocket between doctor blades of the doctoring assembly can be formed by the introduced gas, particularly compressed air, a high pressure (+p) that tends to escape via grooves 2 of the grooved-shell roll outward from under the first doctor blade of the doctoring assembly to the front side, that is, the incoming side of the doctoring assembly. The pressurized gas or compressed air escaping from under the doctor blade via the grooves of the grooved-shell rolls forms in front of and under the doctor blade, into the grooves of the grooved shell roll, a high-pressure barrier zone (+p) that prevents water and/or dirt adhering to the roll grooves from passing via and from under the doctor blade.

A portion of the pressurized gas pumped into the interblade pocket, such as compressed air, tends to escape via the thus cleaned grooves of the grooved-shell roll from under the second doctor blade to the rear side, later called the outgoing side, of the doctoring assembly. Hence, the pressurized gas such as compressed air escaping from under the doctor blade, via the grooves of a grooved-shell roll, generates on the outgoing side of the doctoring assembly and under the doctor blade thereof and into the grooves, a high vacuum (−p) that works by way of an ejector effect so as to remove the possible remains of water and dirt 3 still adhering to the grooves.

Now referring to FIG. 8*b,* therein is shown another embodiment of the doctoring assembly intended for use on a grooved-shell roll, wherein the doctoring assembly 4 comprises two doctor blades mounted in the same doctoring assembly complemented with a purpose-designed gas chamber 5 such as a compressed-air chamber. The interbiade space forms a closed and tightly delineated pocket into which gas, particularly compressed air, can be passed from the compressed-air chamber of the doctoring assembly in a purpose-designed and controlled manner via openings, nozzles and/or slits made to the wall of the chamber in a manner according to the invention. Consequently, into the pocket between doctor blades of the doctoring assembly can be formed by the introduced gas, particularly compressed air, a high pressure (+p) that tends to escape outward to the outgoing side of the doctoring assembly via openings, nozzles and/or slits that are made to the second, latter doctor blade on the rear side the chamber in a purpose-designed manner according to the Invention. Conversely, the pressurized gas such as compressed air escaping via the wall of the doctoring assembly forms behind and under the doctor blade and into the grooves of the grooved-shell roll a high vacuum (−p) that works by way of an ejector effect so as to remove the possible remains of water and dirt 3 still adhering to the grooves.

The above-described features of the doctoring assemblies may also be utilized in conjunction with suction rolls, particularly on perforated suction rolls also having grooves made on the roll shell.

Referring to FIGS. 10 and 11, therein is shown a third embodiment of a doctoring assembly according to the invention suited for replacing a so-called foil today used on suction rolls, grooved-shell rolls and the like. Herein, the doctoring assembly 4 according to the invention incorporates an integral gas chamber 5, particularly a compressed-air chamber, wherefrom the gas such as compressed air is passed in a controlled manner via openings, nozzles and/or slits, which are made in a purpose-designed manner according to the invention to the wall of the compressed-air chamber of the doctoring assembly, to the incoming or front side and/or to the outgoing side of the doctor element of the doctoring assembly or also therebehind and thereunder. Resultingly, the pressurized gas such as compressed air escaping through the second, latter doctor blade forms behind and under the doctor blade and into the perforations 2 of the roll a high vacuum (−p) that works by way of an ejector effect so as to remove the possible remains of water and dirt 3 still adhering to the perforations.

In addition to supporting the travel of a paper web on a papermaking machine, fabrics serve an important function in the elevation of the solids content of the sheet. The water drainage capability of wires must be good to pass the large amounts of water removed from the sheet through wires. Respectively, press felts must both receive the water removed from the sheet during pressing and dryer wires must pass water vapor released by the sheet. Hence, it is most important to assure unproblematic function of fabrics 6 and to maintain their water penetration at their specified performance level throughout their entire life.

To this end of cleaning and/or improving the performance of a fabric used on a papermaking machine or the like machinery, it is possible to utilize a doctoring assembly according to the invention of the kind described above incorporating an integral gas chamber, particularly a compressed-air chamber, wherefrom the gas such as compressed air is passed in a controlled manner via openings, nozzles and/or slits, which are made in a purpose-designed manner according to the invention to the wall of the compressed-air chamber of the doctoring assembly, to the incoming or front side and/or to the outgoing side of the doctor element of the assembly or also therebehind and thereunder. Resultingly, the pressurized gas such as compressed air escaping via the wall of the doctoring assembly forms behind and under the doctor blade and into the fabric 6 a high vacuum (−p) that works by way of an ejector effect so as to remove the possible remains of water and dirt 3 still adhering to the fabric. The doctoring assembly is located to operate in a close proximity to the fabric of a papermaking machine or the like machinery.

Depending on the desired function of the assembly and the construction of the papermaking machine and other factors affecting the location, the doctoring assemblies may be adapted to operate on a papermaking machine at a close proximity to fabrics, in a plurality of different locations upstream or downstream relative to conventional fabric conditioning equipment, particularly upstream and/or downstream of suctions boxes.

As shown in FIG. 12, the apparatus according to the invention may also be used in conjunction with the method disclosed in WO patent publication no. 01/12898 (FI-19991717) so as to control pressure differences at a close proximity of a paper sheet or the like web by way of locating the assembly to operate in the vicinity of the dryer cylinders of a papermaking machine or the like machinery. Herein, the doctoring assembly 4 according to the invention incorporates an integral gas chamber 5, particularly a compressed-air chamber, wherefrom the gas such as compressed air is passed in a controlled manner via openings, nozzles and/or slits, which are made in a purpose-designed manner according to the invention to the wall of the compressed-air chamber of the doctoring assembly, to the incoming or front side and/or to the outgoing side of the doctor element of the assembly or also therebehind and thereunder so that the passage of the material web 7 can be controlled further therefrom in accordance with the method described in cited WO patent publication no. 01/12898 (FI-19991717).

Additionally, the doctoring assembly according to the invention can be provided during its manufacture with different kinds of integral sensors such as thermo-couple wires and the like sensors suited for measuring the temperature and/or temperature profile of roll surfaces, for instance. Furthermore, it is possible to incorporate pressure, deflection, vibration or the like sensors that serve to monitor, e.g., the loading profile and/or possible leak-throughs under the doctoring elements, as well as moisture content, speed, acceleration and other sensors serving to monitor, e.g., the operational state of the doctoring element. With the help of such sensors integrated into the doctoring assembly according to the invention, it becomes possible to monitor the properties of the doctoring elements, rolls, fabrics and/or the paper web, such as the moisture content, temperature, moisture and/or temperature profiles, the contact of the doctoring element with the roll and fabric surfaces, and the like parameters.

A doctoring assembly of the above-described kind may be located, e.g., on the wire section, press section, dryer section, upwinder and/or coater and sizing station of a papermaking machine.

Furthermore, the apparatus and/or method according to the invention can be used for the control of material web crushing problems occurring particularly at the edge areas of a felt and for reduction and control of edge flutter of fabrics by way of utilizing a profile-controlling doctoring assembly according to the invention, wherein the gas can be applied zone-wise in the cross-machine direction to the fabric or a close proximity thereof.

Still further applications of the method according to the invention can be found in the elevation of sheet solids content, for instance. Additionally, the zone-wise controlled doctoring assembly according to the invention can be used to control the moisture profile of the fabric and areas of different water permeability on the fabric by way of, e.g., passing different amounts of gas to different areas of the fabric.

As mentioned above, the invention also relates to an apparatus for cleaning roll surfaces and/or fabrics and/or for improving water drainage on a papermaking machine or the like machinery, the apparatus being suited for implementing the method according to the invention and comprising a doctoring assembly adapted to apply and distribute in a controlled manner gas, typically compressed air, against a moving roll surface 1 and/or grooves 2 and/or perforations 2 of the roll surface and/or a fabric 6 or to a close proximity thereof.

The apparatus comprises a doctoring assembly incorporating doctor blades and an integral gas chamber, particularly a compressed-air chamber. The doctoring assembly according to the invention may consist of a plurality of individually controllable zones serving to impose a zone-wise adjustable profile control of the properties and behavior of a fabric, for instance.

To this end, a doctoring assembly according to the invention may comprise a plurality of separate dosing subassemblies for the application of a gas, typically compressed air, such as a number of parallel compressed-air chambers including different kinds of nozzle orifices and/or adjustable or fixed gas flow control elements or the like.

The apparatus according to the invention also includes means for measuring, conditioning and controlling such variables of the applied gas, typically compressed air, as gas flow, temperature, pressure and composition prior to the application of the gas. Additionally, the apparatus according to the invention includes a control unit with compatible software and automation means. Hence, the apparatus according to the invention permits the application control of the gas, particularly compressed air, to take place either automatically or manually depending on the situation.

The doctoring assembly according to the invention described above is suited for use, retrofitting and adaptation to all conventional and existing holder means of doctoring elements.

To those skilled in the art it is obvious that the invention is not limited by the embodiments described above, but rather, can be varied within the scope and spirit of the appended claims.

What is claimed is:

1. A method for cleaning the surfaces of rolls on a papermaking or boardmaking machine, as well as the grooves and drilled perforations of the rolls, and/or supported fabrics and/or for improving water drainage therein, comprising the steps of:

providing a moving roll and/or fabric, the roll having a surface with grooves and/or perforations thereon;

providing a gas mixture, the composition of which is varied depending on a specific need and application to consist of one or a greater number of components;

directing or applying the gas mixture substantially toward or in close proximity to the roll surface, grooves and perforations of the roll and/or the fabric for affecting properties or a behavior of the moving roll surface and/or the fabric during a run of the papermaking machine.

2. The method according to claim 1, wherein the step of directing or applying the gas mixture toward or in close proximity to the roll surface, grooves and/or perforations of the roll and/or the fabric includes using a distribution/metering means complemented with a doctoring assembly equipped with nozzle orifices.

3. The method according to claim 1, wherein the gas mixture is applied so as to affect at least one property of the roll surface and/or the grooves and/or the perforations of the roll and/or the fabric or, alternatively, the run of the fabric and/or a material web.

4. The method according to claim 1, wherein the gas mixture is applied in a controlledly metered fashion.

5. The method according to claim 1, wherein the state of the gas mixture is monitored and conditioned prior to passing the gas mixture into said distribution/metering means.

6. The method according to claim 1, wherein applying the gas mixture affects at least one of the following variables:

temperature and/or temperature profile of the roll surface and/or the grooves and/or the perforations of the roll shell and/or the fabric, moisture content and/or moisture profile of the roll surface and/or the grooves and/or the perforations of the roll shell and/or the fabric, cleanliness and/or cleaning of the roll surface and/or the grooves and/or the perforations of the roll shell and/or the fabric, water drainage capacity and/or permeability of the grooves and/or the perforations of the roll shell and/or the fabric, adherence of the material web to the surface of the fabric, takeoff of the material web from the surface of a roll, water content of the material web, e.g., through improved drainage of the web by virtue of reducing the amount of entrained water in roll shell grooves and/or perforations and/or in the fabric, entrained amount of air in the fabric, life of the fabric.

7. The method according to claim 1, wherein the distribution /metering means is a gas chamber for compressed air.

8. The method according to claim 1, wherein the gas mixture is compressed air, and the composition of the compressed air is varied depending on a specific need or application to consist of one or a greater number of components.

9. An apparatus for cleaning the surfaces of rolls on a papermaking or boardmaking machine, as well as the grooves and drilled perforations of the rolls, and/or supported fabrics and/or for improving water drainage therein, comprising:

distribution/metering means for selectively varying the composition of a gas mixture depending on a specific need or application to consist of one or a greater number of components, the distribution/metering means being so arranged for directing and applying the gas mixture substantially toward or in close proximity to the roll surface, grooves and/or perforations of the roll shell and/or the fabric, wherein said distribution/metering means includes integrated sensors for monitoring at least temperature, moisture, and speed of a surface of the roll surface and/or the fabric.

10. The apparatus according to claim 9, wherein said distribution/metering means includes at least one control element for conditioning the gas mixture to be applied.

11. The apparatus according to claim 9, wherein the gas distribution/metering system is a doctoring assembly equipped with nozzle orifices.

12. The apparatus according to claim 9, wherein the apparatus includes necessary systems and control elements for implementing a profile-controlling metering system for the application of the gas mixture.

13. The apparatus according to claim 9, wherein the apparatus includes necessary control elements and software for implementing manual or automatic control of the gas distribution/metering system.

14. The apparatus according to claim 9, wherein the apparatus further includes means for conditioning the gas mixture to be applied prior to its metering.

15. The apparatus according to claim 9, wherein the apparatus includes means for controlling the temperature of the gas mixture.

16. The apparatus according to claim 9, wherein the apparatus includes means for controlling the pressure of the gas mixture.

17. The apparatus according to claim 9, wherein the apparatus includes means for controlling the flow of the gas mixture.

18. The apparatus according to claim 9, wherein the gas distribution/metering system includes at least one integrated sensor for monitoring the status of the doctoring assembly.

* * * * *